US011674533B2

(12) United States Patent
Tracy

(10) Patent No.: US 11,674,533 B2
(45) **Date of Patent: *Jun. 13, 2023**

(54) VARIABLE HYDRAULIC PRESSURE RELIEF SYSTEMS AND METHODS FOR A MATERIAL HANDLING VEHICLE

(71) Applicant: The Raymond Corporation, Greene, NY (US)

(72) Inventor: Erik C. Tracy, Johnson City, NY (US)

(73) Assignee: The Raymond Corporation, Greene, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/473,835

(22) Filed: Sep. 13, 2021

(65) Prior Publication Data

US 2022/0010818 A1 Jan. 13, 2022

Related U.S. Application Data

(63) Continuation of application No. 17/095,559, filed on Nov. 11, 2020, now Pat. No. 11,118,607, which is a continuation of application No. 15/872,466, filed on Jan. 16, 2018, now Pat. No. 10,844,880.

(60) Provisional application No. 62/446,973, filed on Jan. 17, 2017.

(51) Int. Cl.

| | |
|---|---|
| ***F15B 11/10*** | (2006.01) |
| ***F15B 11/16*** | (2006.01) |
| ***F15B 1/26*** | (2006.01) |
| ***B66F 9/22*** | (2006.01) |

(52) U.S. Cl.
CPC ..... *F15B 11/10* (2013.01); *B66F 9/22* (2013.01); *F15B 1/26* (2013.01); *F15B 11/16* (2013.01); *F15B 2211/55* (2013.01); *F15B 2211/6336* (2013.01); *F15B 2211/6653* (2013.01)

(58) Field of Classification Search
CPC ..... F15B 2211/55; F15B 2211/6336; F15B 11/16; F15B 11/046; F15B 2211/6653
See application file for complete search history.

(56) References Cited

U.S. PATENT DOCUMENTS

| | | | | |
|---|---|---|---|---|
| 5,313,873 | A * | 5/1994 | Gall | F15B 1/02 91/452 |
| 5,701,933 | A * | 12/1997 | Lunzman | F04B 49/225 91/450 |
| 9,360,023 | B2 * | 6/2016 | Yahner | F15B 21/14 |
| 10,844,880 | B2 * | 11/2020 | Tracy | F15B 11/16 |
| 2013/0183127 | A1 * | 7/2013 | Dammeyer | B66F 9/10 414/592 |
| 2014/0250877 | A1 * | 9/2014 | Bissbort | F15B 9/09 60/393 |

* cited by examiner

*Primary Examiner* — Abiy Teka
(74) *Attorney, Agent, or Firm* — Quarles & Brady LLP

(57) ABSTRACT

A method of controlling a hydraulic control system of a material handling vehicle is provided. The method includes detecting an elevated height of a fork assembly, determining if the elevated height is above a first predetermined height threshold, and actuating a first low pressure control valve from a control valve closed position to a control valve open position to provide fluid communication from a supply passage to the first low pressure relief valve when the elevated height is above a first predetermined height threshold.

20 Claims, 10 Drawing Sheets

VARIABLE HYDRAULIC PRESSURE RELIEF SYSTEMS AND METHODS FOR A MATERIAL HANDLING VEHICLE

CROSS-REFERENCES TO RELATED APPLICATIONS

The present application is a continuation of U.S. patent application Ser. No. 17/095,559, filed on Nov. 11, 2020, which is a continuation of U.S. patent application Ser. No. 15/872,466, filed on Jan. 16, 2018, which is based on and claims priority to U.S. Provisional Patent Application No. 62/446,973, filed on Jan. 17, 2017, and entitled "Variable Hydraulic Pressure Relief Systems and Methods for a Material Handling Vehicle." All of which are incorporated herein by reference in their entirety.

STATEMENT REGARDING FEDERALLY SPONSORED RESEARCH

Not Applicable.

BACKGROUND

The present invention relates generally to hydraulic lift systems and, more specifically, to hydraulic pressure relief systems and methods on material handling vehicles (MHVs).

Hydraulic relief systems on MHVs typically utilize various pressure relief systems to ensure that the hydraulic fluid does not build to a pressure above a predetermined pressure. This predetermined pressure can be calculated based on physical properties (e.g., buckling force, maximum operating pressure, etc.) of the hydraulic components on the MHV (e.g., pistons, valves, fluid paths, etc.).

In a MHV, for example, a hydraulic lift system may be used to raise and lower a fork assembly that is holding a load. Typically, these hydraulic lift systems are provided with a range of predetermined pressures that correspond to how much load the fork assembly can support at a given height, or fork elevation.

SUMMARY OF THE INVENTION

The present invention provides a hydraulic control system for a material handling vehicle including one or more hydraulic actuators configured to raise and lower a fork assembly attached to a mast of the material handling vehicle. The hydraulic control system provides multi-stage pressure relief.

In one aspect, the present invention provides a hydraulic control system for a material handling vehicle. The material handling vehicle includes a pump having a pump outlet, a reservoir, one or more hydraulic actuators, and a controller. The pump outlet is in fluid communication with a supply passage and the reservoir is in fluid communication with a return passage. The one or more hydraulic actuators are configured to raise and lower a fork assembly attached to a mast of the material handling vehicle. The hydraulic control system comprises a high pressure relief valve, a low pressure relief valve, and a low pressure control valve. The high pressure relief valve is configured to provide fluid communication from the supply passage to the reservoir when a pressure upstream of the high pressure relief valve exceeds a high pressure threshold. The low pressure relief valve is arranged on a low pressure relief line, the low pressure relief line connected between the supply passage and the return passage upstream of the high pressure relief valve. The low pressure relief valve is configured to provide fluid communication from the supply passage to the reservoir when a pressure upstream of the low pressure relief valve exceeds a low pressure threshold. The low pressure control valve is arranged on the low pressure relief line upstream of the low pressure relief valve, the low pressure control valve moveable between a control valve open position where fluid communication is provided from the supply passage to the low pressure relief valve and a control valve closed position where fluid communication is inhibited from the supply passage to the low pressure control valve. The low pressure threshold is less than the high pressure threshold and the low pressure control valve is moveable between the control valve open position and the control valve closed position when the fork assembly reaches a predetermined elevated height.

In another aspect, the present invention provides a hydraulic control system for a material handling vehicle. The material handling vehicle includes a pump having a pump outlet, a reservoir, one or more hydraulic actuators, and a controller. The pump outlet is in fluid communication with a supply passage and the reservoir is in fluid communication with a return passage. The one or more hydraulic actuators are configured to raise and lower a fork assembly attached to a mast of the material handling vehicle. The controller is in communication with a height sensor configured to measure a height of the fork assembly. The hydraulic control system comprises a variable pressure relief valve configured to provide fluid communication from the supply passage to the reservoir when a pressure upstream of the variable pressure relief valve exceeds a variable pressure threshold. The variable pressure threshold is set by the controller based on a height of the fork assembly.

In some aspects, the present invention provides a method of controlling a hydraulic control system of a material handling vehicle. The material handling vehicle includes a pump in fluid communication with a supply passage, a reservoir in fluid communication with a return passage, a fork assembly attached to a mast, a high pressure relief valve configured to provide fluid communication from the supply passage to the reservoir when a pressure upstream of the high pressure relief valve exceeds a high pressure threshold, a first low pressure relief valve connected between the supply passage and the return passage, and a first low pressure control valve arranged upstream of the first low pressure relief valve. The method includes detecting an elevated height of the fork assembly, determining if the elevated height is above a first predetermined height threshold, and actuating the first low pressure control valve from a control valve closed position to a control valve open position to provide fluid communication from the supply passage to the first low pressure relief valve when the elevated height is above a first predetermined height threshold.

In some aspects, the present invention provides a method of controlling a hydraulic control system of a material handling vehicle. The material handling vehicle includes a pump in fluid communication with a supply passage, a reservoir in fluid communication with a return passage, a fork assembly attached to a mast, a height sensor configured to detect a height of the fork assembly, and a variable pressure relief valve configured to provide fluid communication from the supply passage to the reservoir when a pressure upstream of the variable pressure relief valve exceeds a variable pressure threshold. The method includes measuring a height of the fork assembly, and adjusting the variable pressure threshold of the variable pressure relief valve based on the height of the fork assembly.

In some aspects, the present invention provides a method of controlling a hydraulic control system of a material handling vehicle. The material handling vehicle including a pump in fluid communication with a supply passage, a reservoir in fluid communication with a return passage, a fork assembly attached to a mast, a height sensor configured to detect a height of the fork assembly, a pressure sensor configured to detect a pressure within the supply passage, and a variable pressure relief valve configured to provide fluid communication from the supply passage to the reservoir when a pressure upstream of the variable pressure relief valve exceeds a variable pressure threshold. The method includes measuring a height of the fork assembly, measuring a pressure within the supply passage, and adjusting the variable pressure threshold of the variable pressure relief valve based on the measured height of the fork assembly and the measured pressure within the supply passage.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

It is also to be appreciated that material handling vehicles (MHVs) are designed in a variety of configurations to perform a variety of tasks. Although the MHV described herein is shown by way of example as a reach truck, it will be apparent to those of skill in the art that the present invention is not limited to vehicles of this type, and can also be provided in various other types of MHV configurations, including for example, orderpickers, swing reach vehicles, and any other lift vehicles. The various pressure relief configurations are suitable for both driver controlled, pedestrian controlled and remotely controlled MHVs.

The various hydraulic components of hydraulic lift systems of MHVs are sized to withstand a predetermined load, or pressure, at a specified height. Once the MHV's required capabilities are determined, the various hydraulic components can be sized appropriately. Typically, various lift ratings are provided, each corresponding to how high the material handling vehicles fork assembly can be raised under different loading situations.

Current single-stage hydraulic pressure relief systems on MHVs are generally set to relieve system pressure at slightly above a predetermined hydraulic pressure that can be exerted on the system. This predetermined hydraulic pressure typically corresponds to a predetermined load at a fork height that is below a maximum fork height. Manufacturers size the various hydraulic components to withstand worst-case scenarios, which arise from the single-stage relief capabilities of the hydraulic system. This can cause component sizing increases that ultimately result in higher costs. It may be desirable to improve the hydraulic pressure relief systems on MHVs to allow for multi-stage hydraulic pressure relief that can provide a lower pressure relief threshold at higher elevations. This can allow for the manufacturer to provide hydraulic components that are sized for intended uses, and are thereby less costly to produce.

Figure 1:
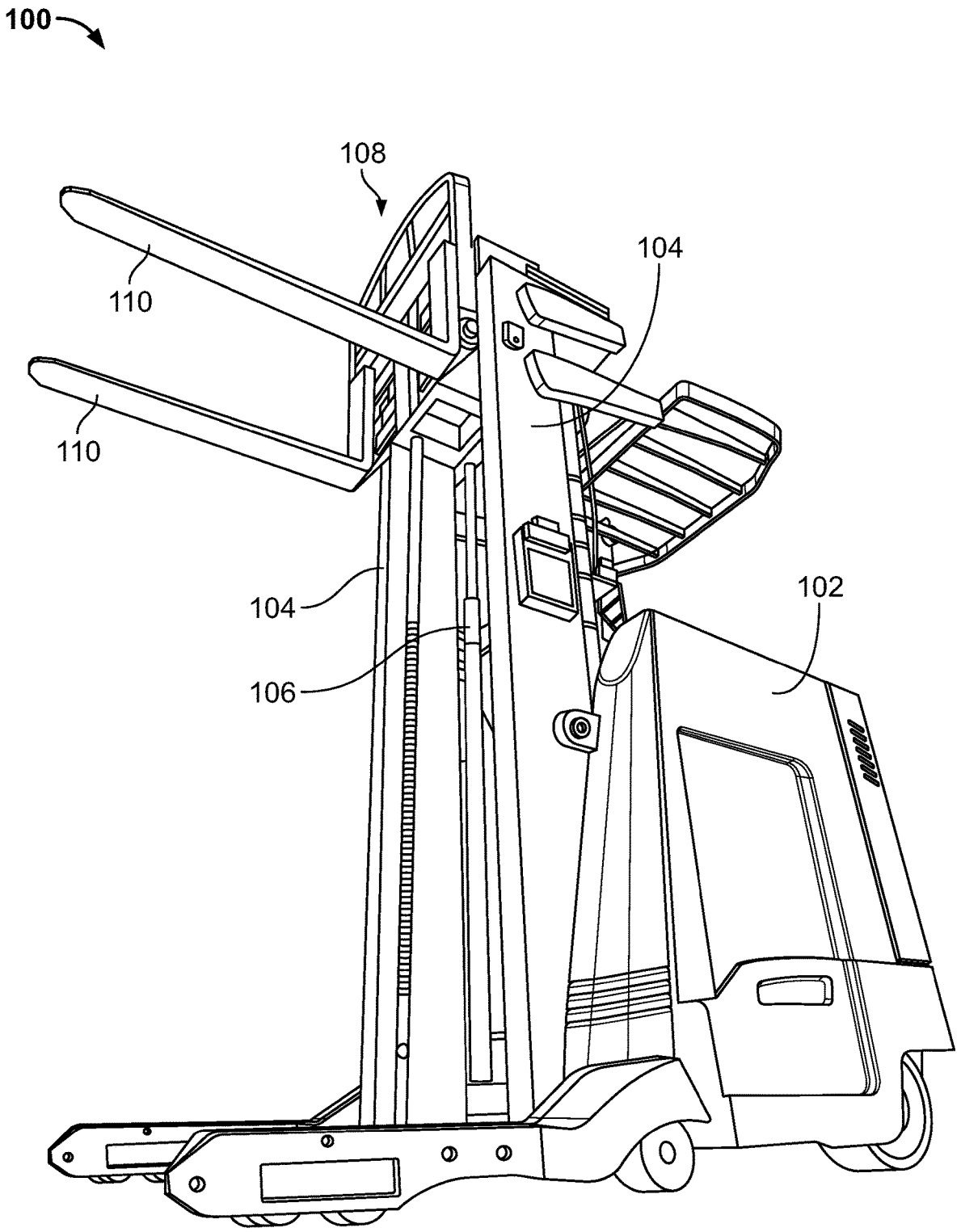
FIG. 1 is a pictorial view of a material handling vehicle in accordance with one embodiment of the present invention.

FIG. 1 illustrates an MHV 100 in the form of a reach truck according to one non-limiting example of the present disclosure. The MHV 100 can include a base 102, a telescoping mast 104, one or more hydraulic actuators 106, and a fork assembly 108. The telescoping mast 104 can be coupled to the hydraulic actuators 106 such that the hydraulic actuators 106 can selectively extend or retract the telescoping mast 104. The fork assembly 108 can be coupled to the telescoping mast 104 so that when the telescoping mast 104 is extended or retracted, the fork assembly 108 can also be raised or lowered. The fork assembly 108 can further include one or more forks 110 on which various loads (not shown) can be manipulated or carried by the MHV 100.

Figure 2:
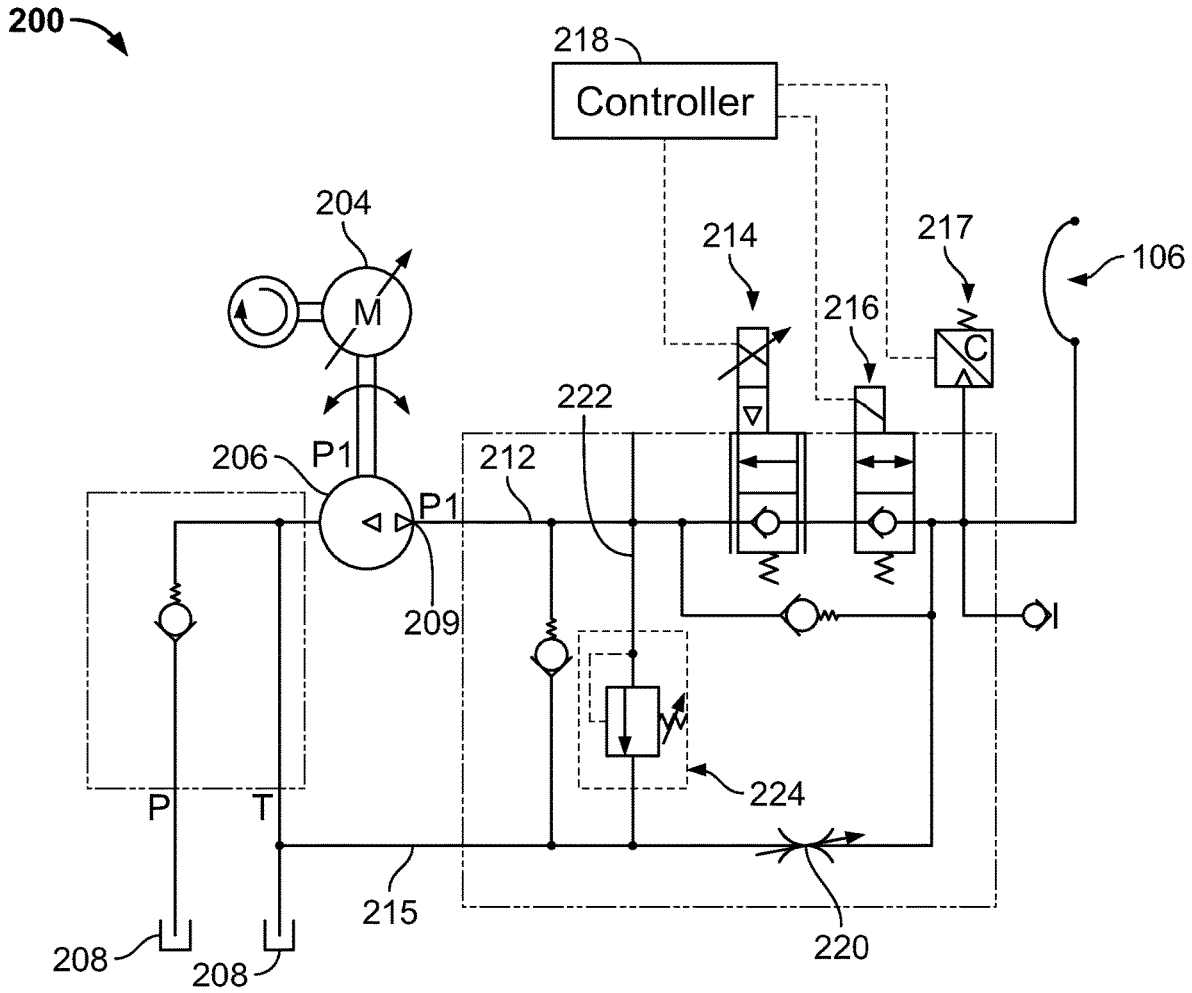
FIG. 2 is a schematic illustration of a single stage relief circuit used in a typical hydraulic relief system.

FIG. 2 illustrates a current hydraulic circuit 200 with a single-stage relief system that can be used to control the hydraulic actuator 106 of the MHV 100. It should be appreciated that the current hydraulic circuit 200 can also be used to control other hydraulic components on the MHV 100.

The current hydraulic circuit 200 can include a motor 204, a hydraulic pump 206, and a reservoir tank 208. The motor 204 can drive the hydraulic pump 206 to draw fluid from the reservoir tank 208 and furnish the fluid under increased pressure at a pump outlet 209. The pump outlet 209 can be in fluid communication with a supply passage 212. A first control valve 214, a second control valve 216, and a pressure sensor 217 can be arranged on the supply passage 212 with the first control valve 214 arranged upstream of the second control valve 216 and the pressure sensor 217 arranged downstream of the second control valve 216. A return passage 215 can provide fluid communication from a location downstream of the second control valve 216 to the reservoir tank 208. The first and second control valves 214 and 216 and the pressure sensor 217 can be in electrical communication with a controller 218.

During operation, the controller 218 can be configured to selectively actuate the first control valve 214 and/or the second control valve 216 to direct fluid flow between the hydraulic actuators 106, the supply passage 212, and the reservoir tank 208. In some non-limiting examples, the hydraulic actuators 106 can be in the form of a piston-cylinder arrangement. It is known in the art that lift cylinders can include a head side and a rod side. The first and second control valves 214 and 216 can be selectively actuated to either direct pressurized fluid from the hydraulic pump 206 to the head side or the rod side, with the other of the two sides connected to the reservoir tank 208. This selective actuation can determine whether the hydraulic actuators 106 extend or retract.

A variable orifice 220 can be arranged on the return passage 215 at a location upstream of the reservoir tank 208. The variable orifice 220 can be configured to build pressure at a location downstream of the hydraulic actuators 106 and upstream of the reservoir tank 208 on the return passage 215 to ensure the hydraulic actuators 106 retract at a predetermined rate.

Figure 3:
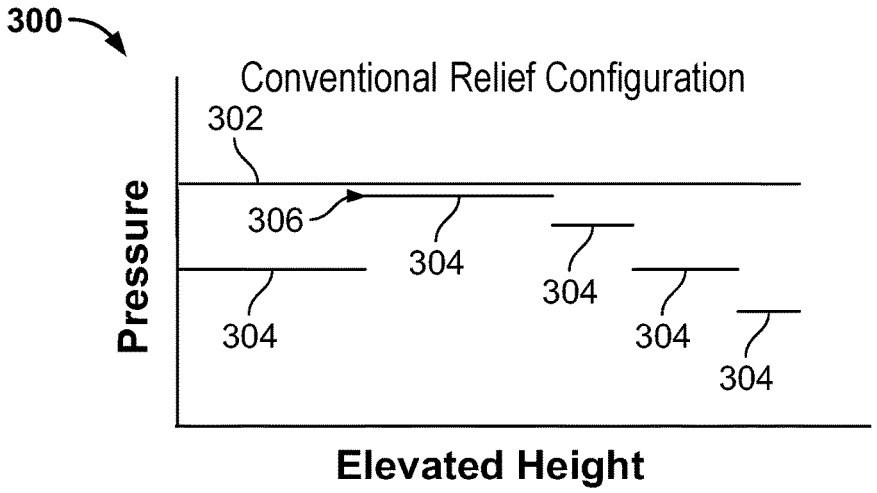
FIG. 3 is a graph illustrating a material handling vehicle system pressure at a predetermined capacity and a typical hydraulic relief pressure as a function of elevated height.

A pressure relief line 222 can provide fluid communication from the supply passage 212 at a location upstream of the first control valve 214 to the return passage 215 at a location downstream of the variable orifice 220. A pressure relief valve 224 can be arranged on the pressure relief line 222. The pressure relief valve 224 can be biased into a first position where fluid communication is inhibited across the pressure relief valve 224 from the supply passage 212 to the return passage 215. The pressure relief valve 224 can be biased into a second position when a pressure upstream of the pressure relief valve 224 is greater than a pressure relief threshold 302 (FIG. 3). In the second position, the pressure relief valve 224 can provide fluid communication from the supply passage 212 to the return passage 215, thereby relieving the pressure applied to the components of the current hydraulic circuit 200.

FIG. 3 shows a graph 300 illustrating a relationship between the pressure relief threshold 302 of the pressure relief valve 224 and a predetermined system pressure 304 of the hydraulic circuit 200 as a function of elevated height of the fork assembly 108. The predetermined system pressure 304 corresponds to the pressure within the supply passage 212, when the MHV 100 is lifting a predetermined load capacity for a given elevated height of the fork assembly 108. As illustrated, the predetermined system pressure 304 initially increases to an uppermost predetermined system pressure 306 and then decreases at higher elevations. Due to the single-stage nature (i.e., one, constant relief pressure) of the current hydraulic circuit 200, the pressure relief threshold 302 of the pressure relief valve 224 stays constant, at slightly above the uppermost predetermined system pressure 306 for all elevated heights of the fork assembly 108.

Figure 4:
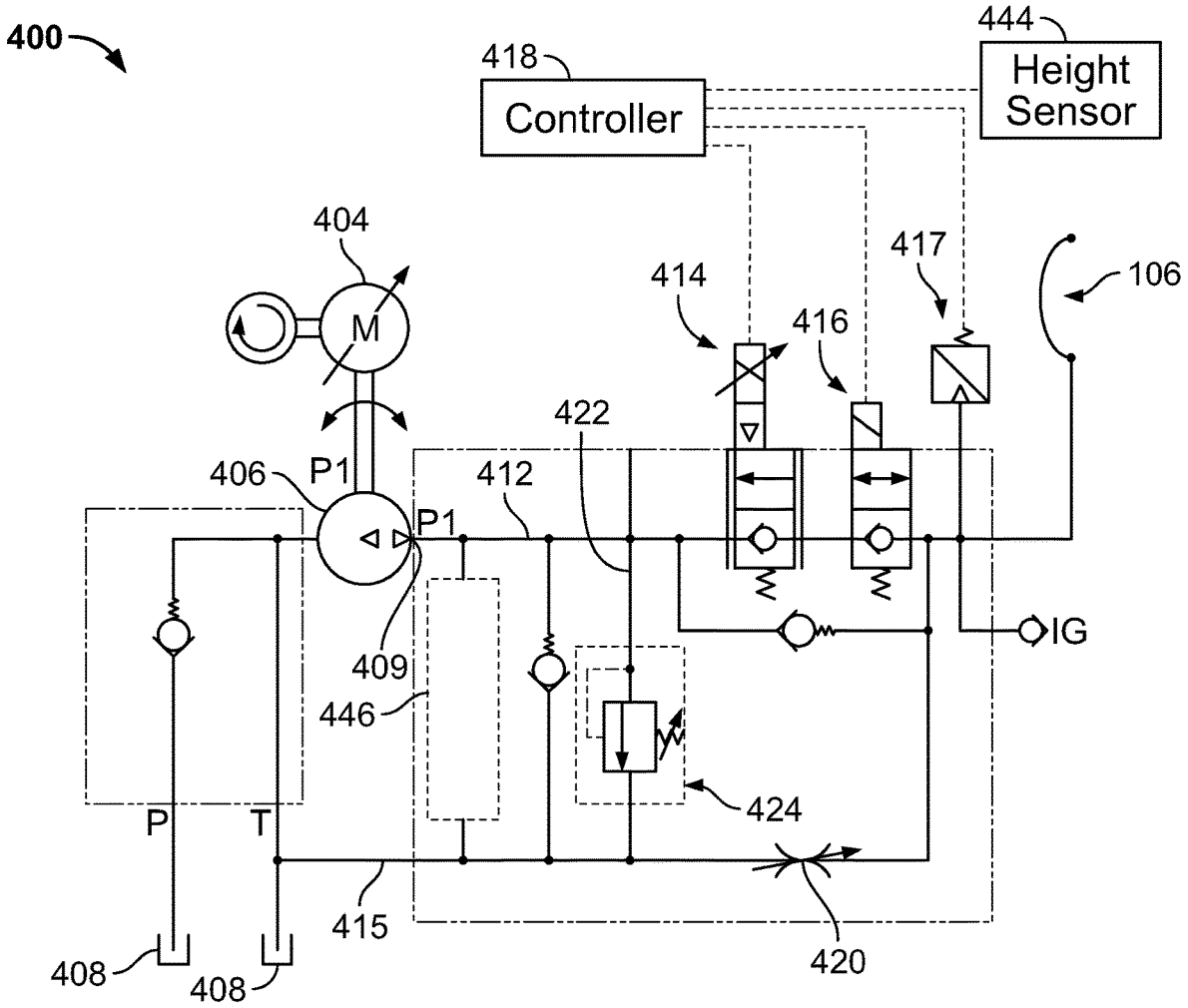
FIG. 4 is a schematic illustration of a relief circuit configured to provide multi-stage relief in accordance with one embodiment of the present invention.

FIG. 4 shows one embodiment of a hydraulic circuit 400 similar to the current hydraulic circuit 200, with similar parts labeled with like numbers in the 400 series, which can be used with the MHV 100 of FIG. 1. The hydraulic circuit 400 includes a controller 418 in communication with height sensor 444, which can sense an elevation height of fork assembly 108, and an additional circuit component 446, which can comprise a multitude of varying elements that can be implemented to allow for multi-stage or variable pressure relief, as will be described below.

Figure 5:
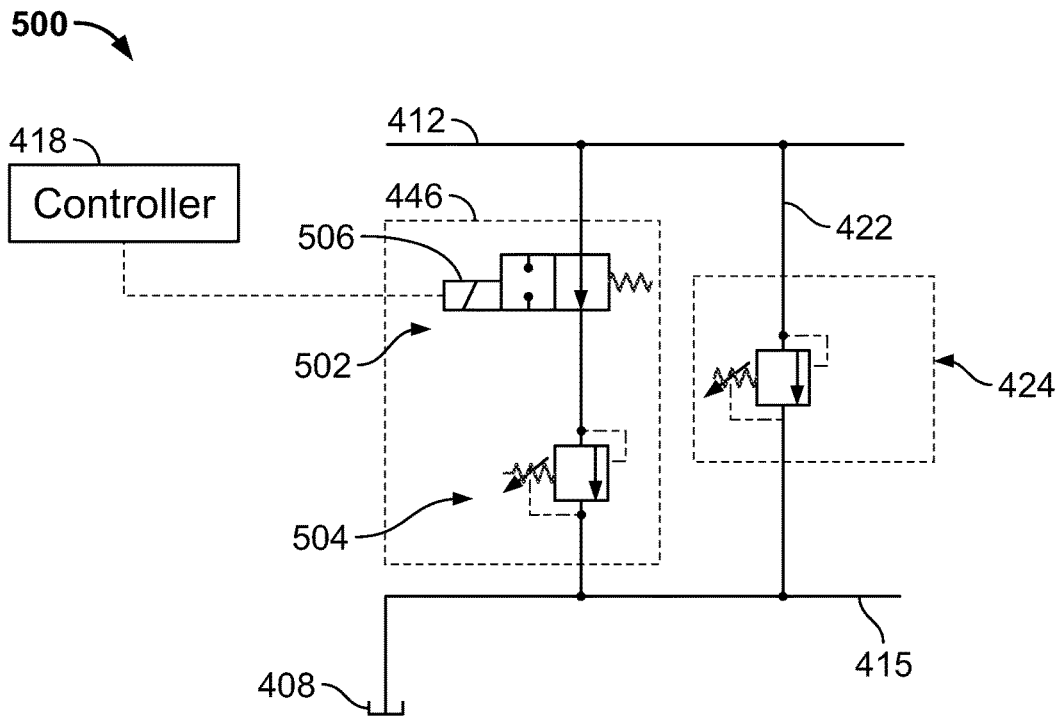
FIG. 5 is a schematic illustration of a dual-stage relief option that may be implemented in the relief circuit of FIG. 4.

FIG. 5 shows one embodiment of a selective low pressure relief system 500 that can be implemented into the hydraulic circuit 400 of FIG. 4 as the additional circuit component 446. The selective low pressure relief system 500 can provide fluid communication between the supply passage 412 and the return passage 415, to allow for dual-stage pressure relief. The selective low pressure relief system 500 can include a relief control valve 502 and a low pressure relief valve 504. The relief control valve 502 can be arranged upstream of the low pressure relief valve 504 and can be selectively moveable by the controller 418 between an open position and a closed position. In the open position, the relief control valve 502 can be configured to permit fluid flow from the supply passage 412 to the low pressure relief valve 504. In the closed position, the relief control valve 502 can be configured to inhibit fluid flow from the supply passage 412 to the low pressure relief valve 504. The relief control valve 502 can be actuated between the open and closed positions by a solenoid 506. The solenoid 506 can be in communication with the controller 418. The low pressure relief valve 504 can have a low pressure relief threshold setting 706 that is lower than a pressure relief threshold setting 702 of the pressure relief valve 424, as will be described with reference to FIG. 7.

Figure 6:
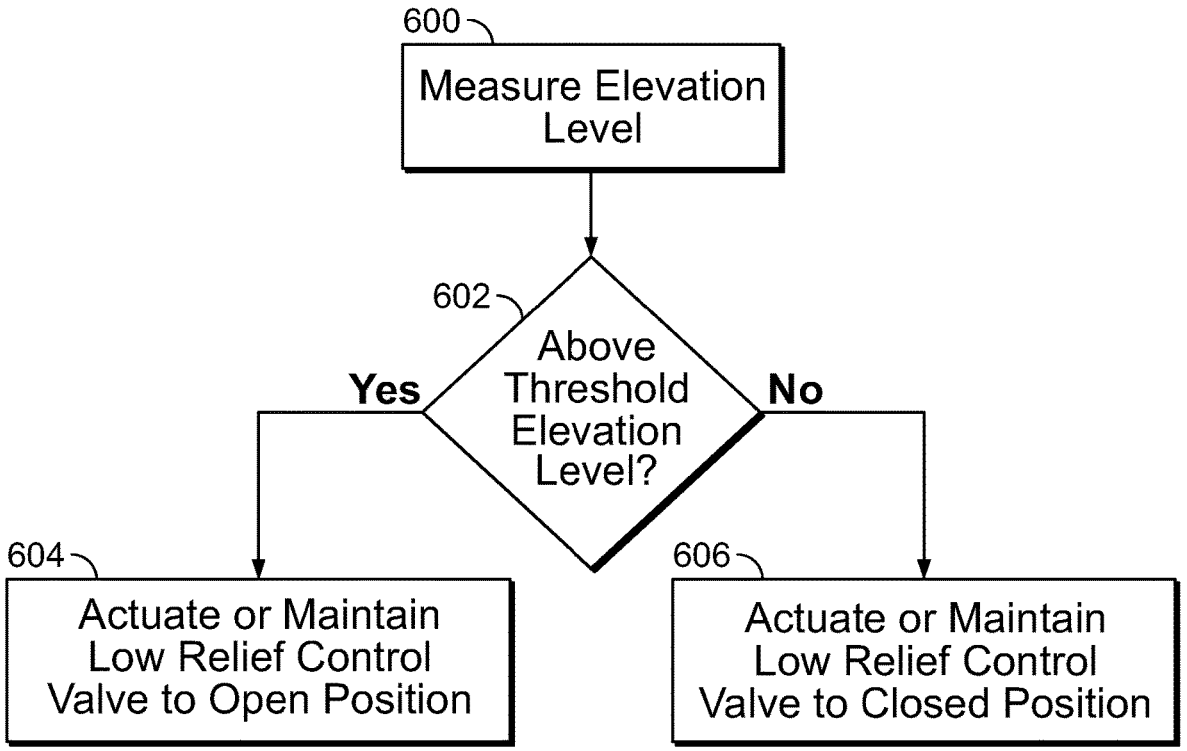
FIG. 6 is a flowchart illustrating steps for switching between a high pressure setting and a low pressure setting using a dual-stage pressure relief system in accordance with one embodiment of the present invention.

FIG. 6 illustrates one non-limiting example of steps for switching between a high pressure setting and a low pressure setting while using the hydraulic circuit 400 of FIG. 4 with the selective low pressure relief system 500 implemented as the additional circuit component 446. During operation, the controller 418 can measure, at step 600, the elevation height of the fork assembly 108 using the height sensor 444. After measuring the elevation height at step 600, the controller 418 can determine, at step 602, if the elevation height is above a threshold elevation height 708 (shown in FIG. 7). If the controller 418 determines that the elevation height is above the threshold elevation height 708, the controller 418 can actuate the relief control valve 502 to the open position, at step 604. By actuating the relief control valve 502 to the open position, fluid communication can be provided from the supply passage 412 to the low pressure relief valve 504. Thus, once the hydraulic pressure in the supply passage 412 upstream of the first control valve 414 exceeds the low pressure relief threshold setting 706 of the low pressure relief valve 504, the low pressure relief valve 504 will open up and provide fluid communication from the supply passage 412 to the return passage 415, thereby relieving the hydraulic pressure within the supply passage 412. If the controller 418 alternatively determines that the elevation height is not above the threshold elevation height 708, the controller 418 can instead actuate the relief control valve 502 to the closed position, at step 606, or if the relief control valve 502 is already in the closed position, it can maintain the relief control valve 502 in this position. With the relief control valve 502 in the closed position, the hydraulic fluid cannot enter the selective low pressure relief system 500. Therefore, the hydraulic pressure in the supply passage 412 cannot be relieved until it reaches the pressure relief threshold setting 702 of the pressure relief valve 424 within the pressure relief line 422.

Figure 7:
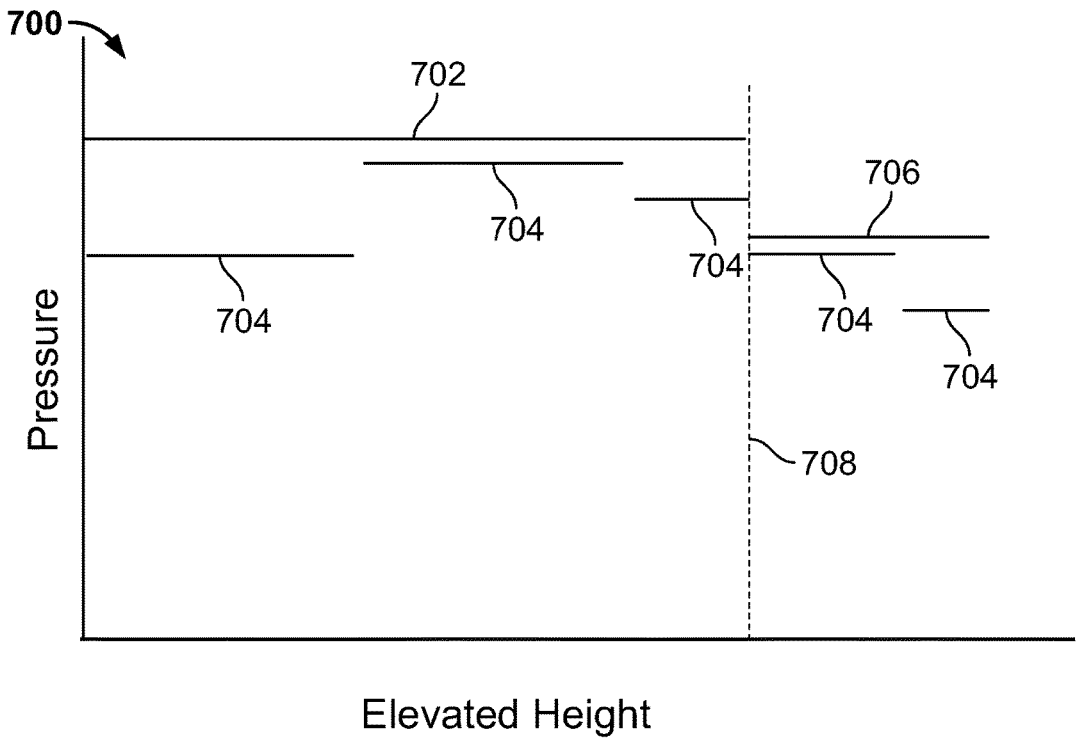
FIG. 7 is a graph illustrating a material handling vehicle system pressure at a predetermined capacity and a dual-stage hydraulic relief pressure as a function of elevated height.

FIG. 7 shows a graph 700 illustrating the relationship between the pressure relief threshold setting 702, the low pressure relief threshold setting 706, and a predetermined system pressure 704 of the hydraulic circuit 400 as a function of elevation height of the fork assembly 108. The predetermined system pressure 704 is similar to the predetermined system pressure 304 of graph 300. However, with this dual-stage pressure relief provided by the selective low pressure relief system 500, the pressure relief threshold setting 702 drops to the low pressure relief threshold setting 706 once the fork assembly exceeds the threshold elevation height 708. This can aid in preventing the heaviest loads from exceeding the threshold elevation height 708 and, thereby, the various hydraulic components may be sized accordingly.

Figure 8:
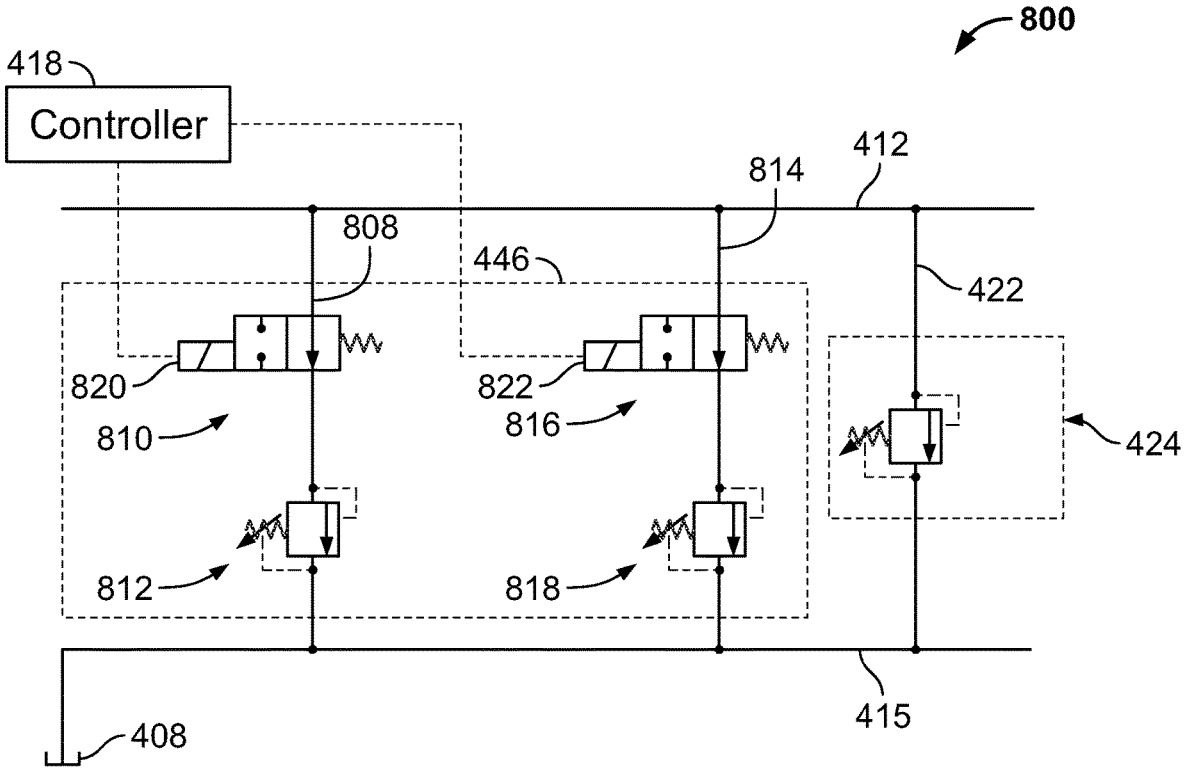
FIG. 8 is a schematic illustration of a multi-stage relief option that may be implemented in the relief circuit of FIG. 4.

FIG. 8 shows one embodiment of a selective low pressure relief system 800 that can be implemented into the hydraulic circuit 400 of FIG. 4 as the additional circuit component 446. The selective low pressure relief system 800 can provide fluid communication between the supply passage 412 and the return passage 415, to allow for multi-stage pressure relief. The selective low pressure relief system 800 can include a first relief fluid path 808 including a first relief control valve 810 and a first low pressure relief valve 812 similar to the relief control valve 502 and the low pressure relief valve 504 of the selective low pressure relief system 500. The selective low pressure relief system 800 can further include a second relief fluid path 814 arranged parallel to the first relief fluid path 808 and including a second relief control valve 816 and a second low pressure relief valve 818. The first low pressure relief valve 812 can have a first low pressure relief threshold setting 1010 that is lower than the pressure relief threshold setting 702 of the pressure relief valve 424, as will be described below with reference to FIG. 10. The second low pressure relief valve 818 can have a second low pressure relief threshold setting 1012 that is lower than the first low pressure relief threshold setting 1010, as will also be described below with reference to FIG. 10. The first and second relief control valves 810, 816 can be selectively moveable between open and closed positions similar to the relief control valve 502 of the selective low pressure relief system 500. Additionally, the first and second relief control valves 810, 816 can be actuated between their respective open and closed positions by first and second solenoids 820, 822 respectively. Furthermore, the first and second solenoids 820, 822 can also be in communication with the controller 418.

Figure 9:
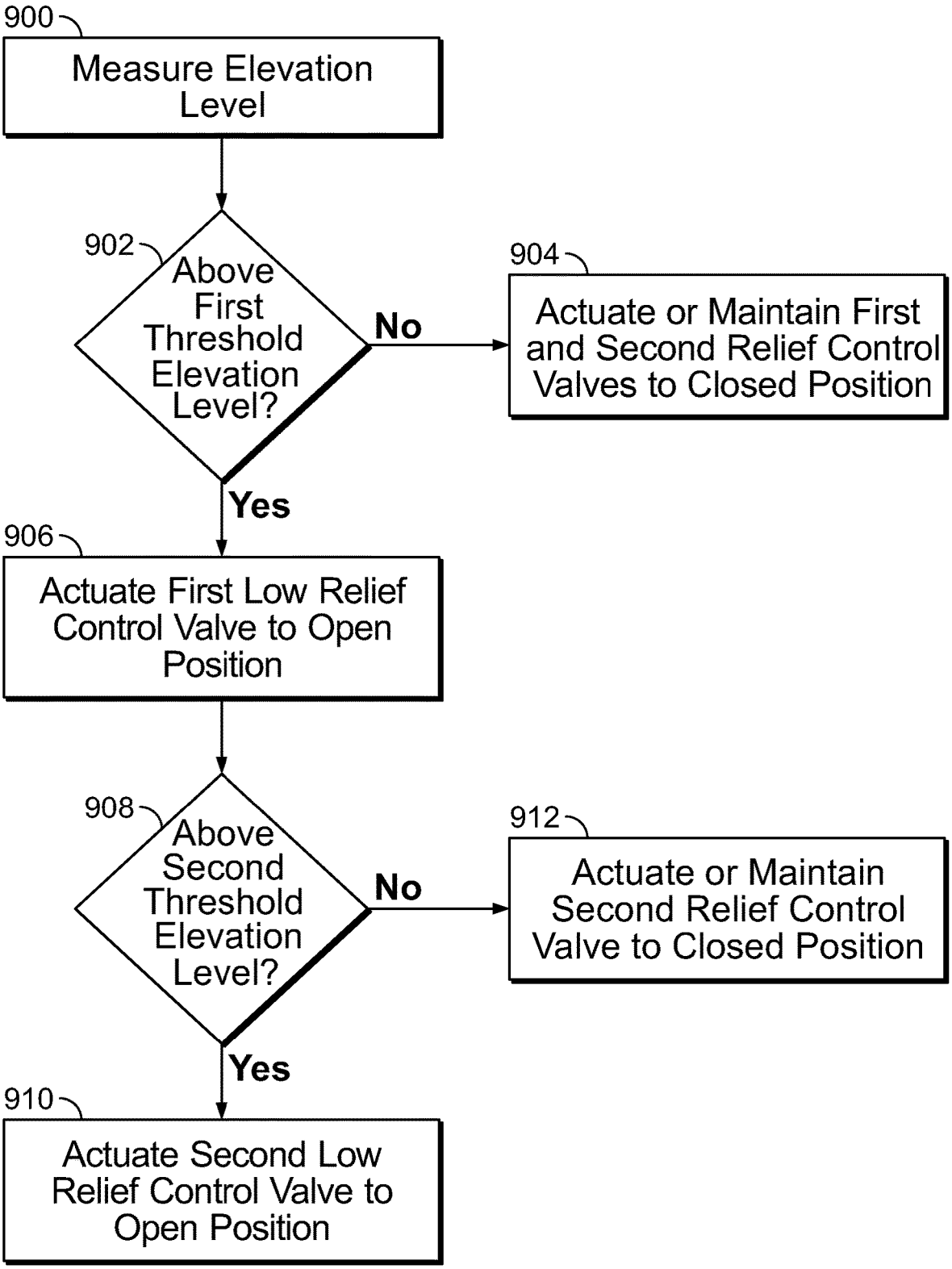
FIG. 9 is a flowchart illustrating steps for switching between multiple pressure settings using a multi-stage pressure relief system in accordance with one embodiment of the present invention.

FIG. 9 illustrates one non-limiting example of the steps for switching between a high pressure setting, a middle pressure setting, and a low pressure setting while using the hydraulic circuit 400 of FIG. 4 with the selective low pressure relief system 800 implemented as the additional circuit component 446. During operation, the controller 418 can measure, at step 900, the elevation height of the fork assembly 108 using the height sensor 444. After measuring the elevation height at step 900, the controller 418 can determine, at step 902, if the elevation height is above a first threshold elevation height 1014 (shown in FIG. 10). If the controller 418 determines that the elevation height is not above the first threshold elevation height 1014, the controller 418 can actuate the first and second relief control valves 810, 816 to their closed positions, at step 904, or maintain the first and second relief control valves 810, 816 in the closed positions. By actuating or maintaining the first and second relief control valves 810, 816 in their closed positions, hydraulic fluid cannot enter the first or second relief fluid paths 808, 814 of the selective low pressure relief system 800. Therefore, the hydraulic pressure in the supply passage 412 cannot be relieved until it meets or exceeds the pressure relief threshold setting 702 of the pressure relief valve 424 within the pressure relief fluid path 420, as described above.

Alternatively, if the controller 418 determines that the elevation height is above the first threshold elevation height 1014, the controller 418 can actuate the first relief control valve 810 to the open position, at step 906. By actuating the first relief control valve 810 to the open position, fluid communication can be provided from the supply passage 512 to the first low pressure relief valve 812. Thus, once the hydraulic pressure in the supply passage 412 upstream of the first control valve 414 exceeds the first low pressure relief threshold setting 1010 of the first low pressure relief valve 812, the first low pressure relief valve 812 will open and provide fluid communication from the supply passage 412 to the return passage 415, thereby relieving the hydraulic pressure within the supply passage 412. After actuating the first relief control valve 810 to the open position, the controller 418 can then determine if the elevation height is above a second threshold elevation height 1016 (shown in FIG. 10), at step 908. If the controller 418 determines that the elevation height is above the second threshold elevation height 1016, the controller 418 can actuate the second relief control valve 816 to the open position, at step 910. Similarly, by actuating the second relief control valve 816 to the open position, fluid communication can be provided from the supply passage 412 to the second low pressure relief valve 818. Thus, once the hydraulic pressure in the supply passage 412 upstream of the first control valve 414 exceeds the second low pressure relief threshold setting 1012 of the second low pressure relief valve 818, the second low pressure relief valve 818 will open up and provide fluid communication from the supply passage 412 to the return passage 412. If the controller 418 alternatively determines that the elevation height is not above the second threshold elevation height 1016, the controller 418 can instead actuate the second relief control valve 816 to the closed position or maintain the second relief control valve 816 in the closed position, at step 912. By actuating or maintaining the second relief control valve 816 to or in the closed position, the hydraulic fluid cannot enter the second relief fluid path 814. Therefore, the hydraulic pressure in the supply passage 412 will not be relieved until it meets or exceeds the first low pressure relief threshold setting 1010 of the first low pressure relief valve 812, as described above.

Figure 10:
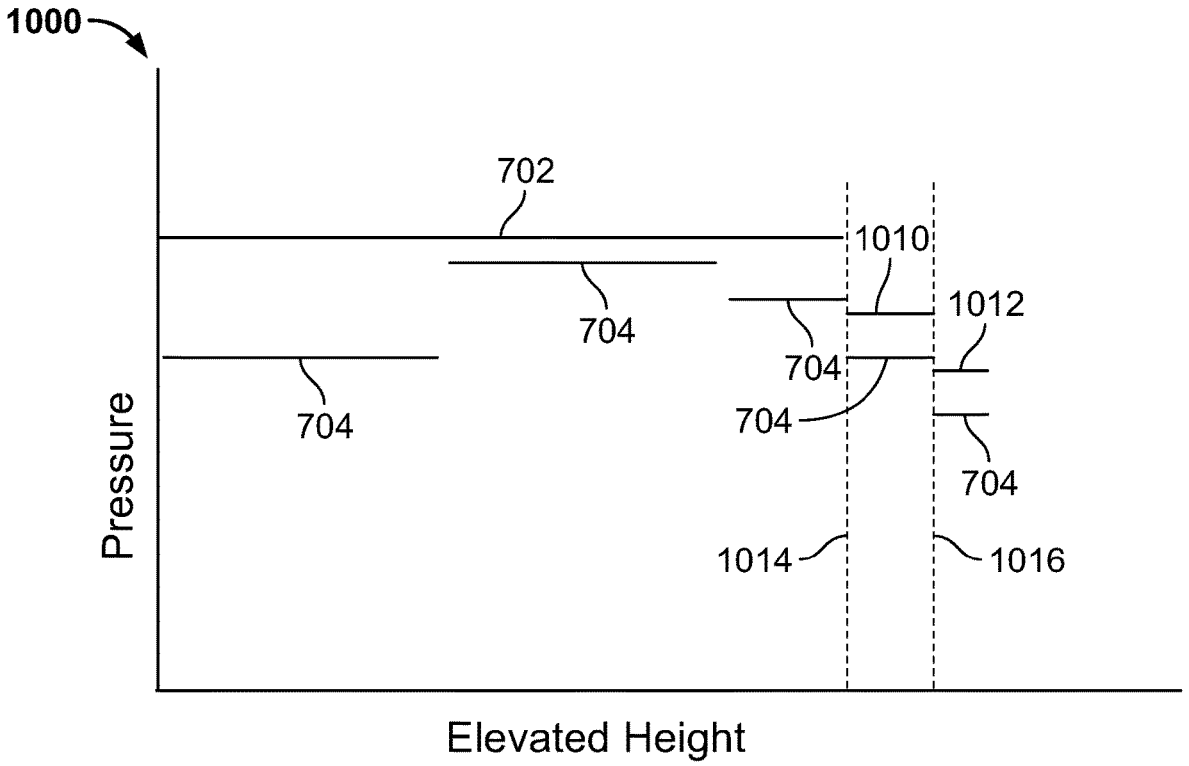
FIG. 10 is a graph illustrating a material handling vehicle system pressure at a predetermined capacity and a multi-stage hydraulic relief pressure as a function of elevated height.

FIG. 10 shows a graph 1000 illustrating the relationship between the pressure relief threshold setting 702 of the pressure relief valve 424, the first and second low pressure relief threshold settings 1010, 1012, and the predetermined system pressure 704 of the hydraulic circuit 400 as a function of elevation height of the fork assembly 108. The predetermined system pressure 704 is again similar to the predetermined system pressure 304 of graph 300. With the multi-stage pressure relief, the pressure relief threshold setting 702 drops to the first low pressure relief threshold setting 1010 once the hydraulic actuator 106 exceeds the first threshold elevation height 1014. The first low pressure relief threshold setting 1010 then drops to the second low pressure relief threshold setting 1012 once the hydraulic actuator 106 exceeds the second threshold elevation height 1016. This can further aid in preventing the heaviest loads from exceeding the threshold elevation heights 1014, 1016 and, thereby, the various hydraulic components may be sized accordingly.

Figure 11:
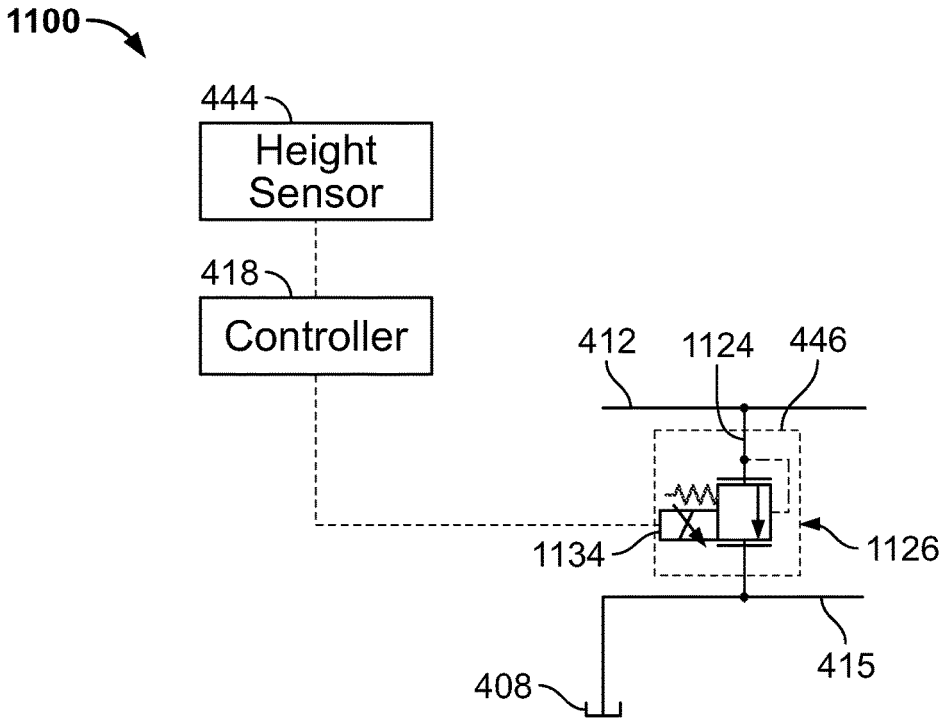
FIG. 11 is a schematic illustration of a variable relief option that may be implemented in the relief circuit of FIG. 4.

FIG. 11 shows one embodiment of a variable pressure relief system 1100 that can be implemented into the hydraulic circuit of FIG. 4 as the additional circuit component 446. The variable pressure relief system 1100 can provide fluid communication between the supply passage 412 and the return passage 415, to allow for variable pressure relief. The variable pressure relief system 1100 can include a variable pressure relief fluid path 1124 including a variable pressure relief valve 1126. The variable pressure relief valve 1126 can be operated by a solenoid 1134 that is in communication with the controller 418. The variable pressure relief valve 1126 can have a variable pressure relief threshold setting 1302 (illustrated in FIG. 13), which can be variably set by actuating the solenoid 1134 to various positions to provide various pressure thresholds based on the predetermined capacities at varying elevations, as will be described below.

Figure 12:
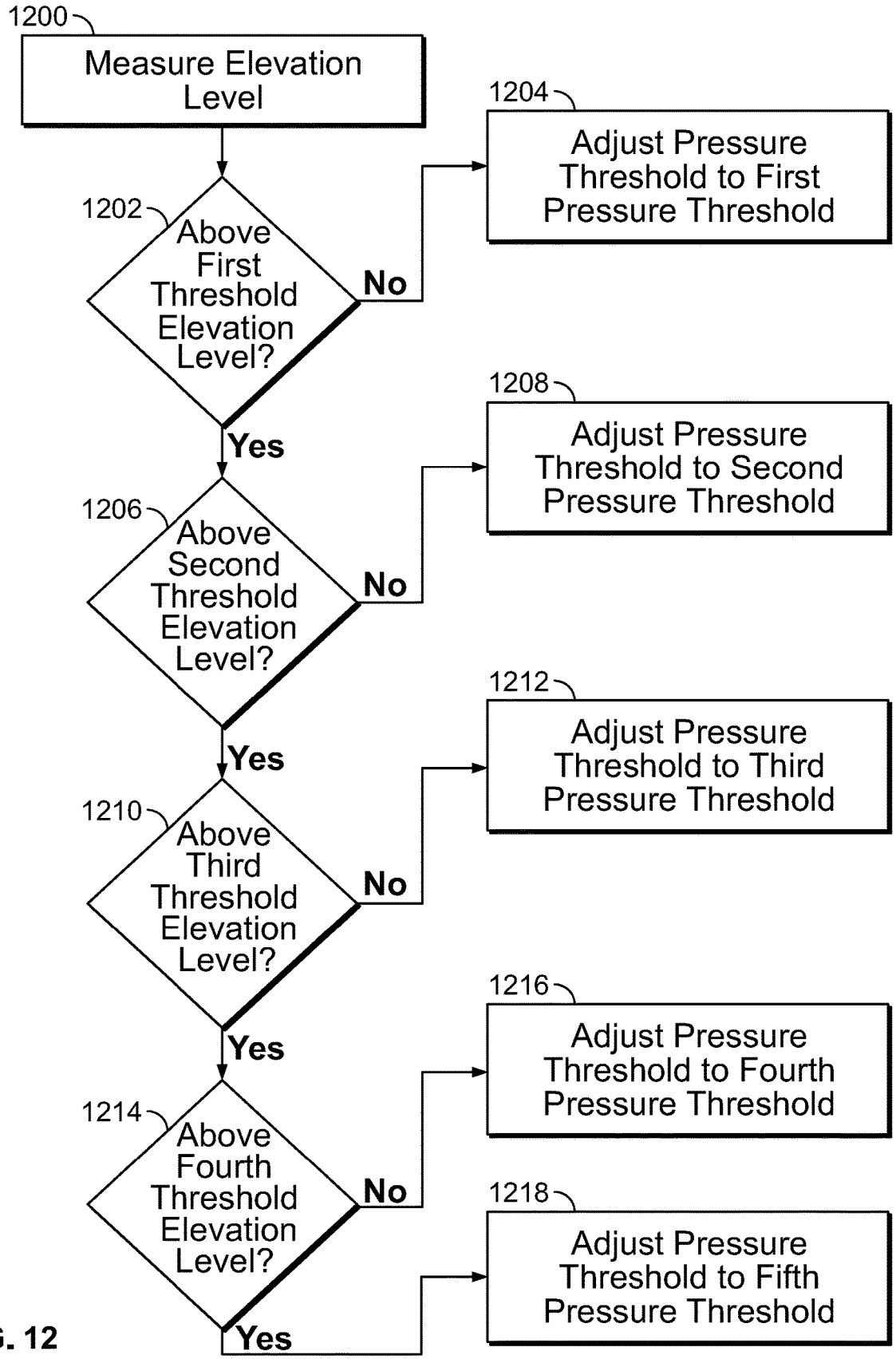
FIG. 12 is a flowchart illustrating steps for operating a variable pressure relief system in accordance with one embodiment of the present invention.

FIG. 12 illustrates one non-limiting example of the steps for adjusting between pressure thresholds while using the hydraulic circuit 400 of FIG. 4 with the variable pressure relief system 1100 implemented as the additional circuit component 446. During operation, the controller 418 can measure, at step 1200, the elevation height of the fork assembly 108 using the height sensor 444. After measuring the elevation height at step 1200, the controller 418 can determine, at step 1202, if the elevation height is above a first threshold elevation height 1314 (shown in FIG. 13), similar to the first threshold elevation height 1014 of FIG. 10. If the controller 418 determines that the elevation height is not above the first threshold elevation height 1314, the controller 418 can actuate the solenoid 1134 to a first location to provide a first pressure threshold 1306, at step 1204. If the controller 418 determines that the elevation height is above the first threshold elevation height 1314, the controller 418 can then determine, at step 1206, if the elevation height is above a second threshold elevation height 1316, similar to the second threshold elevation height 1016 of FIG. 10. If the controller 418 determines that the elevation height is not above the second threshold elevation height 1316, the controller 418 can actuate the solenoid 1134 to a second location to provide a second pressure threshold 1308, at step 1208. If the controller 418 determines that the elevation height is above the second threshold elevation height 1316, the controller 418 can then determine, at step 1210, if the elevation height is above a third threshold elevation height 1318. If the controller 418 determines that the elevation height is not above the third threshold elevation height 1318, the controller 418 can actuate the solenoid 1134 to a third location to provide a third pressure threshold 1310, at step 1212. If the controller 418 determines that the elevation height is above the third threshold elevation height 1318, the controller 418 can determine, at step 1214, if the elevation height is above a fourth threshold elevation height 1320. If the controller 418 determines that the elevation height is not above the fourth threshold elevation height 1320, the controller 418 can actuate the solenoid 1134 to a fourth location to provide a fourth pressure threshold 1312, at step 1216. If the controller 418 determines that the elevation height is above the fourth threshold elevation height 1320, the controller 418 can actuate the solenoid 1134 to a fifth location to provide a firth pressure threshold 1313, at step 1218.

Figure 13:
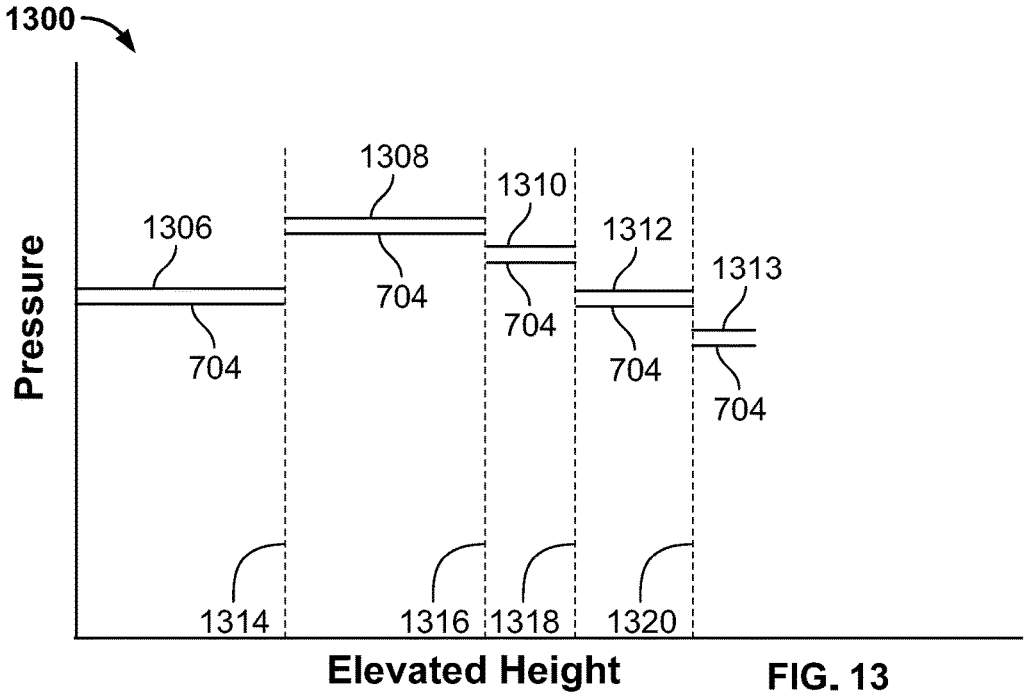
FIG. 13 is a graph illustrating a material handling vehicle system pressure at a predetermined capacity and a variable relief pressure as a function of elevated height.

FIG. 13 shows a graph 1300 illustrating the relationship between the variable pressure relief threshold setting 1302 and the predetermined system pressure 704 of the hydraulic circuit 400 versus various elevation heights. Again, the predetermined system pressure 704 is similar to the predetermined system pressure 304 of graph 300. With the variable pressure relief, the variable pressure relief threshold setting 1302 follows the predetermined system pressure 704 by comparing the measured elevation height to the predetermined threshold elevation heights and correspondingly adjusting the variable pressure relief threshold setting 1302 to the first, second, third, fourth, and fifth pressure thresholds 1306, 1308, 1310, 1312, 1313 at the first, second, third, and fourth elevation heights 1314, 1316, 1318, 1320. This automatic adjustment can further aid in allowing the various hydraulic components to be sized accordingly. It should be appreciated that the number of pressure thresholds and corresponding elevations heights shown in FIG. 13 is not meant to be limiting in any way and, in other non-limiting examples, more or less than five may be provided.

Figure 14:
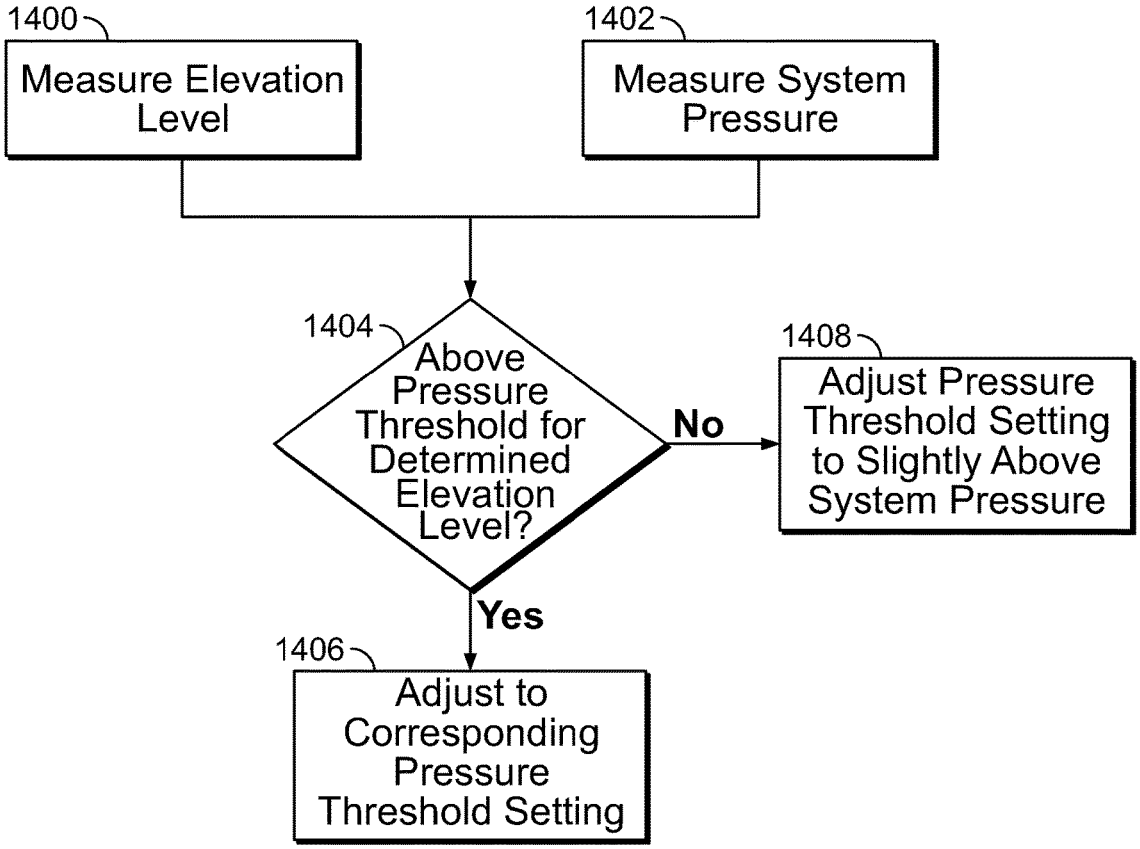
FIG. 14 is a flowchart illustrating steps for operating a variable pressure relief system in accordance with another embodiment of the present invention.

FIG. 14 illustrates another non-limiting example of the steps for adjusting between pressure thresholds while using the hydraulic circuit 400 of FIG. 4 with the variable pressure relief system 1100 implemented as the additional circuit component 446. During operation, the controller 418 can measure, at step 1400, the elevation height of the fork assembly 108 using the height sensor 444. Simultaneously, or consecutively, the controller 418 can measure, at step 1402, a system pressure 1504 using the pressure sensor 417. The controller 418 can then determine, by comparing the measured elevation height and system pressure to preset values corresponding to the various lift ratings, if the system pressure is above the predetermined system pressure 704 for the elevation height, at step 1404. If the controller 418 determines that the system pressure is higher than the predetermined system pressure 704 at step 1404, the controller 418 can actuate the solenoid 1134 to a location to provide a pressure threshold corresponding to the predetermined system pressure 704, at step 1406. If the controller 418 determines, at step 1404, that the system pressure is lower than the predetermined system pressure 704, the controller 418 can actuate the solenoid 1134 to a location to provide a proportional pressure relief threshold setting 1502 that is slightly higher than the system pressure, at step 1408.

Figure 15:
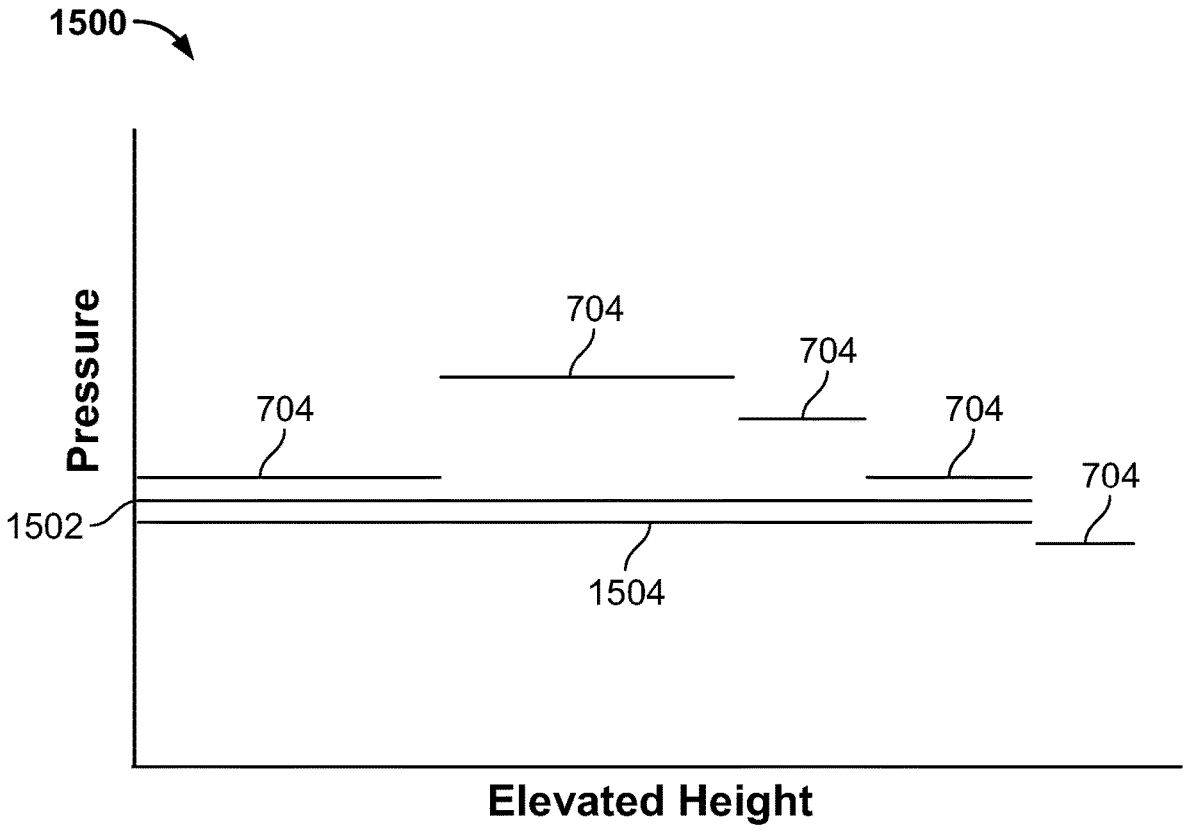
FIG. 15 is a graph illustrating a material handling vehicle system pressure at a predetermined capacity, an active proportional variable relief pressure, and a variable relief pressure as a function of elevated height.

FIG. 15 shows a graph 1500 illustrating the relationship between the proportional pressure relief threshold setting 1502, the predetermined system pressure 704, and an exemplary system pressure 1504 versus various elevation heights. While the exemplary system pressure 1504 remains below the predetermined system pressure 704, the proportional pressure relief threshold setting 1502 remains slightly above the system pressure 1504. When the system pressure 1504 exceeds the predetermined system pressure 704, the proportional pressure relief threshold setting 1502 is set at the predetermined system pressure 704.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

I claim:

1. A material handling vehicle comprising:

a mast;

a fork assembly attached to the mast;

a controller in communication with a height sensor configured to sense a height of the fork assembly; and a hydraulic control system comprising:

at least one hydraulic actuator configured to raise and lower the fork assembly;

a reservoir tank;

a supply passage;

a return passage in fluid communication with the reservoir tank;

a pump configured to draw fluid from the reservoir tank and provide pressurized fluid to the supply passage; and a relief system arranged between the supply passage and the return passage, the relief system including at least one valve in communication with the controller;

wherein the at least one valve is configured to change a pressure relief threshold of the hydraulic control system between a first pressure relief threshold and a second pressure relief threshold based on the height of the fork assembly sensed by the height sensor.

2. The material handling vehicle of claim 1, wherein when the fork assembly is raised to a predetermined height, the at least one valve is commanded by the controller to change the pressure relief threshold of the hydraulic control system from the first pressure relief threshold to the second pressure relief threshold.

3. The material handling vehicle of claim 2, wherein the second pressure relief threshold is less than the first pressure relief threshold.

4. The material handling vehicle of claim 1, further comprising a control valve arrangement arranged on the supply passage and in communication with the controller, wherein the control valve arrangement is configured to be selectively actuated under control of the controller to actuate the at least one hydraulic actuator to raise or lower the fork assembly.

5. The material handling vehicle of claim 4, wherein the at least one valve is arranged on a pressure relief line in communication with the supply passage and the return passage.

6. The material handling vehicle of claim 5, wherein the pressure relief line is in communication with the supply passage at a location downstream of the pump and upstream of the control valve arrangement.

7. The material handling vehicle of claim 1, wherein the at least one valve is a solenoid-operated variable pressure relief valve that is controllable with the controller between a plurality of pressure relief thresholds, including the first pressure relief threshold and the second pressure relief threshold.

8. The material handling vehicle of claim 1, wherein the hydraulic control system further includes:

a first pressure relief valve configured to provide the first pressure relief threshold;

a second pressure relief valve configured to provide the second pressure relief threshold; and wherein the at least one valve is a return control valve arranged upstream of the second pressure relief valve, wherein the return control valve is operable with the controller to selectively provide or inhibit fluid flow to the second relief valve such that the hydraulic control system relieves pressure at the second pressure relief threshold or the first pressure relief threshold, respectively.

9. The material handling vehicle of claim 8, wherein the first pressure relief valve and the second pressure relief valve are arranged in parallel between the supply passage and the return passage.

10. The material handling vehicle of claim 8, wherein the first pressure relief valve is arranged on a first pressure relief line in fluid communication with the supply passage and the return passage.

11. The material handling vehicle of claim 10, wherein the second pressure relief valve is arranged on a second pressure relief line in fluid communication with the supply passage and the return passage.

12. A hydraulic control system for a material handling vehicle, the material handling vehicle including a supply passage for receiving pressurized fluid from a pump, a return passage for providing fluid communication with a reservoir tank, at least one hydraulic actuator configured to raise and lower a fork assembly of the material handling vehicle, the hydraulic control system comprising:

a controller in communication with a sensor for detecting a height of the fork assembly; and a valve for adjusting a pressure relief threshold for the hydraulic control system, operable with the controller, based on the height of the fork assembly;

wherein the valve for adjusting the pressure relief threshold is configured to change the pressure relief threshold from a first pressure relief threshold for a first range of fork assembly heights to a second pressure relief threshold for a second range of fork assembly heights when the height of the fork assembly is outside the first range of fork assembly heights, as detected by the sensor.

13. The hydraulic control system of claim 12, wherein the valve for adjusting the pressure relief threshold is in communication with the controller.

14. The hydraulic control system of claim 12, wherein the valve for adjusting the pressure relief threshold is arranged on a pressure relief line that is in fluid communication with the supply passage and the return passage.

15. The hydraulic control system of claim 12, wherein the second pressure relief threshold is less than the first pressure relief threshold.

16. The hydraulic control system of claim 12, wherein the second range of fork assembly heights is greater than the first range of fork assembly heights.

17. A hydraulic control system for a material handling vehicle, the material handling vehicle including a supply passage for receiving pressurized fluid from a pump, a return passage for providing fluid communication with a reservoir tank, at least one hydraulic actuator configured to raise and lower a fork assembly of the material handling vehicle, the hydraulic control system comprising:

a height sensor configured to detect a height of the fork assembly;

a pressure sensor configured to detect a pressure in the supply passage;

a controller in communication with the height sensor and the pressure sensor; and a variable pressure relief valve that is controllable with the controller between a plurality of pressure relief settings;

the controller being configured to:

measure the pressure in the supply passage;

measure the height of the fork assembly; and determine if the measured pressure is above a predetermined pressure threshold corresponding to the height of the fork assembly;

wherein when the measured pressure is below the predetermined pressure threshold corresponding to the height of the fork assembly, the variable pressure relief valve is set to a pressure relief setting that is configured to relieve pressure at a pressure that is above the measured pressure.

18. The hydraulic control system of claim 17, wherein when the measured pressure is above the predetermined pressure threshold corresponding to the height of the fork assembly, the variable pressure relief valve is set to a pressure relief setting that is configured to relieve pressure at the predetermined pressure threshold.

19. The hydraulic control system of claim 17, wherein the variable pressure relief valve is a solenoid-operated variable pressure relief valve.

20. The hydraulic control system of claim 17, wherein the variable pressure relief valve is arranged on a pressure relief line in communication with the supply passage and the return passage.

* * * * *